US011268793B2

(12) United States Patent
Lee et al.

(10) Patent No.: US 11,268,793 B2
(45) Date of Patent: Mar. 8, 2022

(54) DETONATION CONNECTOR HAVING EXPOSURE PART FOR TAGGING

(71) Applicant: HANWHA CORPORATION, Seoul (KR)

(72) Inventors: Doo Hyun Lee, Boeun-gun (KR); Ki Chul Park, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 146 days.

(21) Appl. No.: 16/627,650

(22) PCT Filed: Dec. 12, 2019

(86) PCT No.: PCT/KR2019/017624

§ 371 (c)(1),
(2) Date: Dec. 30, 2019

(87) PCT Pub. No.: WO2020/130490

PCT Pub. Date: Jun. 25, 2020

(65) Prior Publication Data

US 2021/0404784 A1 Dec. 30, 2021

(30) Foreign Application Priority Data

Dec. 19, 2018 (KR) ..... 10-2018-0165387

(51) Int. Cl.

| | |
|---|---|
| ***F42C 19/12*** | (2006.01) |
| ***F42D 3/04*** | (2006.01) |
| ***F42D 1/045*** | (2006.01) |

(52) U.S. Cl.
CPC ..... *F42C 19/12* (2013.01); *F42D 1/045* (2013.01); *F42D 3/04* (2013.01)

(58) Field of Classification Search
CPC . F42D 1/043; F42D 1/045; F42D 1/05; F42D 1/055; F42D 3/05; F42B 3/103;
(Continued)

(56) References Cited

U.S. PATENT DOCUMENTS

2007/0249204 A1 10/2007 Petersen et al.

FOREIGN PATENT DOCUMENTS

CN 205079683 U 3/2016
JP 3266221 B2 3/2002
(Continued)

*Primary Examiner* — Bret Hayes
(74) *Attorney, Agent, or Firm* — Westerman, Hattori, Daniels & Adrian, LLP

(57) ABSTRACT

The present disclosure relates to a detonation connector having an exposure part for tagging, the detonation connector includes: an electrically conductive wire-connecting bracket member having a plurality of electric wire mounting grooves to which a leg line or a leading line is mounted; a lower casing member at which the wire-connecting bracket member is positioned; and an upper casing member covering the lower casing member, wherein the upper casing member or the lower casing member is provided with a tagging exposure part that exposes a part of the wire-connecting bracket member wire-connecting the leg line and the leading line, so that the tagging work of charging initialization time to a detonator can be performed without opening the upper casing member, and the convenience and the efficiency of the tagging work can be improved.

16 Claims, 8 Drawing Sheets

(58) Field of Classification Search
CPC ..... F42C 19/02; F42C 19/06; F42C 19/12; F42C 21/00
USPC ..... 102/275.12
See application file for complete search history.

(56) References Cited

FOREIGN PATENT DOCUMENTS

| | | | | | |
|---|---|---|---|---|---|
| KR | 10-2001-0078027 | A | | 8/2001 | |
| KR | 10-1195188 | B1 | | 10/2012 | |
| KR | 10-1925572 | B1 | | 12/2018 | |
| WO | WO-2012059877 | A1 | * | 5/2012 | ..... F42D 1/043 |

* cited by examiner

DETONATION CONNECTOR HAVING EXPOSURE PART FOR TAGGING

TECHNICAL FIELD

The present invention relates to a detonation connector having an exposure part for tagging and, more particularly, to a detonation connector having an exposure part for tagging, the detonation connector having a tagging exposure part that enables the tagging work of charging an initialization time to a detonator without opening the detonation connector.

BACKGROUND ART

In general, explosives are used in engineering work, such as in rock blasting for tunneling work and in the demolition of buildings. That is, a plurality of holes, into which explosives are to be inserted, is drilled to correspond to the sections of a blasting target, i.e. the object to be blasted. After an explosive is inserted into each of the drilled holes, the explosives are connected to a blasting system. The explosives are ignited by operating the blasting system, thereby exploding the blasting target.

Such a blasting system includes a detonator serving as an igniter to ignite an explosive and a blasting device providing power necessary for the actuation of the detonator and a command signal to the detonator. Here, the detonator of the blasting system is generally implemented as an electric detonator or an electronic detonator. The electric detonator or the electronic detonator is disposed on an explosive side, and a plurality of detonators is connected to a single blasting device.

Such electric detonators or electronic detonators may have a structure in which a plurality of detonators connected to a blasting device is simultaneously activated to simultaneously detonate explosives when the blasting device transmits a command thereto, or a structure in which a plurality of detonators connected to a blasting device is set to have different delay times to be sequentially activated to thus sequentially detonate explosives.

A leg line connected to an electric detonator or an electronic detonator or a leading line connected to a blasting device is formed in a shape of peeling a sheath at an end thereof, and is connected with a leading line, a leg line, and an auxiliary leading line of another electric detonator and another electronic detonator for blasting work. In this case, in places such as a tunnel that is a humid place, a connection portion of the leg line, etc. may be exposed to ground current or leakage current so there is a risk of a safety accident due to an explosion.

The safety accident may be a greater accident especially when an operator who installs an electric detonator or an electronic detonator in an explosive is directly in contact with a tube of the electric detonator or the electronic detonator.

Accordingly, a detonation connector has been proposed to prevent an accident that may occur when a leg line and a leading line of an electric detonator or an electronic detonator are electrically connected.

The detonation connector prevents a safety accident due to ground current or leakage current, and solves an inconvenience that an operator directly uncovers sheaths of wires and connects the wires.

As a related patent to the present disclosure, Korean Utility Model Registration No. 20-0410147 'Wire connector for electric detonator' (Registration Date: Feb. 24, 2006) has been proposed.

'Wire connector for electric detonator' includes: an insulated housing having a side with an opening through which a leg line passes; a pressing member hinge-coupled to the insulated housing at one end thereof and then rotated downwards; and an equipotential connection member, which is pressed by the pressing member when the pressing member is rotated downwards, and has a plurality of long holes for connecting a leg line corresponding to the opening, so that opposite ends of the leg line are fixed at an inside of the insulated housing.

In 'Wire connector for electric detonator', when the leg line is inserted into the long holes by downwards rotational force of the pressing member, a part of a core wire of the leg line is cutout and the leg line is installed to be conductible to the long holes, thereby achieving equipotentiality of the leg line.

However, in 'Wire connector for electric detonator', when tagging work of charging initialization time to a detonator by electrical connection to a logger device, and of checking abnormality in the connection between the detonator and the leg line is performed, there is an inconvenience of connecting the connector to an external terminal of the logger device in a state where an upper cover of the connector is opened and then a connecting bracket is exposed to the outside.

Further, in 'Wire connector for electric detonator', there is a problem of unstable connection between a leg line and a leading line, since the connector has a linear equipotential connection member of a single connect structure.

DISCLOSURE

Technical Problem

Accordingly, the present invention has been made keeping in mind the above problems occurring in the prior art, and an object of the present invention is to provide a detonation connector having an exposure part for tagging, wherein an upper casing member or a lower casing member is provided with a tagging exposure part that exposes a part of a wire-connecting bracket member connecting a leg line and a leading line together, thereby enabling the tagging work of charging an initialization time to a detonator to be performed without opening the detonation connector.

Another object of the present invention is to provide a detonation connector having an exposure part for tagging, wherein a double contact structure is secured to stably wire-connect a leg line with a leading line, thereby securing the connection stability and the connection reliability of the leg line and the leading line.

Technical Solution

In order to accomplish the above object, the present invention provides an embodiment of a detonation connector having an exposure part for tagging, the detonation connector includes: a wire-connecting bracket member made of an electrically conductive material, and having a plurality of electric wire mounting grooves to which a leg line or a leading line of a detonator is mounted; a lower casing member at which the wire-connecting bracket member is positioned; and an upper casing member covering an upper portion of the lower casing member, wherein the upper casing member or the lower casing member may be provided with a tagging exposure part that may expose a part of the wire-connecting bracket member.

A casing connection hinge part may be provided at a rear surface of the lower casing member and a rear surface of the upper casing member to connect the lower casing member with the upper casing member in a state where the upper casing member is rotatable, a casing locking part may be provided at front surfaces of the lower casing member and the upper casing member to fix a position of the upper casing member in a closed state.

The tagging exposure part may include a first exposure part, which exposes a first wire-connecting bracket part that wire-connects a first leading line to a first leg line, and a second exposure part, which exposes a second wire-connecting bracket part that wire-connects a second leading line and a second leg line.

The tagging exposure part may be positioned in the lower casing member to expose a part of the wire-connecting bracket member.

The tagging exposure part may be formed in a groove-shaped void space at a bottom surface of the lower casing member, which may be connected to a bracket mounting part, in order to expose the wire-connecting bracket member mounted to the bracket mounting part of the lower casing member, and the wire-connecting bracket member may be positioned to protrude from a bottom of the tagging exposure part that may be formed in the groove-shaped void space.

A height of the wire-connecting bracket member may be formed lower than a depth of the tagging exposure part based on the bottom surface of the lower casing member.

When tagging terminals of a tagging logger equipment are connected to the wire-connecting bracket member, opposite side surfaces of the upper casing member or opposite side surfaces of the lower casing member may be supported between a pair of tagging guide members of the tagging logger equipment, and may guide the wire-connecting bracket member to be connected to the tagging terminals.

A side surface of the upper casing member or a side surface of the lower casing member may be provided with a ball insertion groove in which a ball plunger that may protrude from an inside surface of each of the tagging guide members may be inserted.

Connection insertion parts may be positioned in opposite sides of the upper casing member or opposite sides of the lower casing member for insertion of the tagging guide members when the upper casing member is closed.

The connection insertion parts may be formed in a depressed shape at the opposite side surfaces of the upper casing member and the opposite side surfaces of the lower casing member, respectively, so that the upper casing member or the lower casing member may be positioned between the tagging guide members, thus the opposite side surfaces of the upper casing member and the opposite side surfaces of the lower casing member may be supported by being in contact with inside surfaces of the tagging guide members.

The lower casing member may be provided with opposite lower side walls, the lower side walls protruding upwards, and each of the opposite lower side walls may be provided with lower passing holes, the lower passing holes being open at upper portions thereof and passing the leading line, the upper casing member may be provided with opposite upper side walls, the upper side walls protruding downwards and overlapping the lower side walls, each of the opposite upper side walls may be provided with upper passing holes, the upper passing holes being open at lower portions thereof and passing the leading line, and the leading line may be fixed in a state of being pressed between the lower passing holes and the upper passing holes.

When the upper casing member is closed, the upper side walls may be positioned to partially overlap the lower side walls in contact with outside surfaces of the lower side walls.

Each of the upper passing holes may be provided with a leading line partitioning part at a center thereof, the leading line partitioning part protruding to partition a space through which the leading line may pass.

The lower casing member may have an upper surface with a bracket mounting part to which the wire-connecting bracket member may be coupled in a mounted state, the wire-connecting bracket member may be mounted to the bracket mounting part to be positioned on the upper surface of the lower casing member in a state of protruding, the upper casing member may have a lower surface with a wire-connecting press part that may press the leading line or the leg line to be inserted into the electric wire mounting groove so that the leg line or the leading line may be wire-connected to the wire-connecting bracket member, the wire-connecting press part may be provided with a bracket insertion part in which a part of the wire-connecting bracket member may be inserted when the upper casing member is closed, and when the upper casing member is closed, the wire-connecting bracket member may be inserted into the bracket insertion part, and then the wire-connecting press part may press the leg line or the leading line placed on an opening of the electric wire mounting groove in order to insert the leg line or the leading line into the electric wire mounting groove, so that a sheath of the leg line or the leading line may be peeled off in the electric wire mounting groove and the leg line or the leading line may be connected to the wire-connecting bracket member.

The wire-connecting bracket member may be formed in a 'U'-shape formed such that a pair of brackets each having a plurality of electric wire mounting grooves to which the leg line or the leading line may be mounted may be connected together by a connection bracket.

In order to accomplish the above object, the present invention provides another embodiment of a detonation connector having an exposure part for tagging, the detonation connector includes: a wire-connecting bracket member made of electrically conductive material, and having a plurality of electric wire mounting grooves to which a leg line or a leading line of a detonator is mounted; a lower casing member at which the wire-connecting bracket member is positioned; and an upper casing member covering an upper portion of the lower casing member, wherein a casing connection hinge part may be provided at a rear surface of the lower casing member and a rear surface of the upper casing member to connect the lower casing member with the upper casing member in a state where the upper casing member may be rotatable, a casing locking part may be provided at front surfaces of the lower casing member and the upper casing member to fix a position of the upper casing member in a closed state, the lower casing member may have an upper surface with a bracket mounting part to which the wire-connecting bracket member may be coupled in a mounted state, the wire-connecting bracket member may be mounted to the bracket mounting part to be positioned on the upper surface of the lower casing member in a state of protruding, the upper casing member may have a lower surface with a wire-connecting press part that may press a leading line or a leg line to be inserted into the electric wire mounting groove so that the leg line or the leading line may be wire-connected to the wire-connecting bracket member, the wire-connecting press part may be provided with a bracket insertion part in which a part of the wire-connecting bracket member may be inserted when the upper casing member is closed, when the upper casing member is closed, the wire-connecting bracket member may be inserted into the bracket insertion part, and then the wire-connecting press part may press the leg line or the leading line placed on an opening of the electric wire mounting groove in order to insert the leg line or the leading line into the electric wire mounting groove, so that a sheath of the leg line or the leading line may be peeled off in the electric wire mounting groove and the leg line or the leading line may be connected to the wire-connecting bracket member, the upper casing member or the lower casing member may be provided with a tagging exposure part that may expose a part of the wire-connecting bracket member, the tagging exposure part may be formed in a groove-shaped void space at a bottom surface of the lower casing member, which may be connected to a bracket mounting part, in order to expose the wire-connecting bracket member mounted to the bracket mounting part of the lower casing member, and the wire-connecting bracket member may be positioned to protrude from a bottom of the tagging exposure part that may be formed in the groove-shaped void space.

Advantageous Effects

As described above, the present disclosure is configured such that the upper casing member or the lower casing member is provided with the tagging exposure part that exposes a part of the wire-connecting bracket member wire-connecting the leg line and the leading line together. Accordingly, the tagging work of charging initialization time to a detonator can be performed without opening the upper casing member, and the convenience and the efficiency of the tagging work can be improved.

The present disclosure is configured to secure the double contact structure to perform stable wire-connection of the leg line and the leading line so that the connection stability and the connection reliability of the leg line and the leading line can be secured, thus it is possible to prevent the occurrence of large accidents due to malfunctions during wire-connection work, and it is possible to reduce the blasting delay time and the trouble shooting time that are critical issues caused by a connection problem.

DESCRIPTION OF REFERENCE NUMERALS

Figure 1:
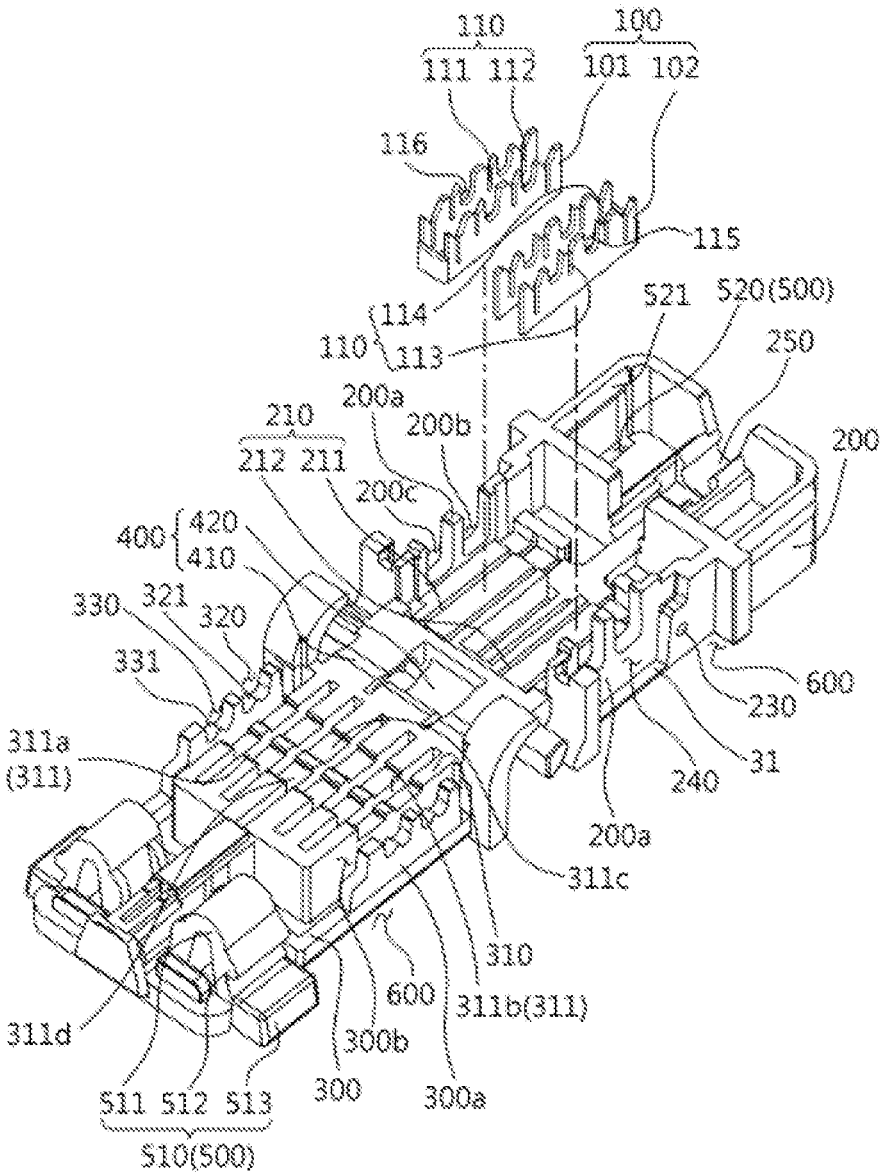
FIG. 1 is an exploded-perspective view showing a detonation connector having a tagging exposure part according to an embodiment of the present disclosure.

10: leg line
11: first leg line
12: second leg line
20: leading line
21: first leading line
22: second leading line
30: tagging logger equipment
31: tagging terminal
32: tagging guide member
32*a*: ball plunger
40: double coated electric wire
50: single coated electric wire
100: wire-connecting bracket member
101: first wire-connecting bracket member
102: second wire-connecting bracket member
110: electric wire mounting groove
111: first leading line mounting groove
112: first leg line mounting groove
113: second leading line mounting groove
114: second leg line mounting groove
115: first leading line passing hole
116: second leading line passing hole
200: lower casing member
200*a*: lower side wall
200*b*: first lower passing hole
200*c*: second lower passing hole
210: bracket mounting part
211: first bracket mounting part
212: second bracket mounting part
220: tagging exposure part
221: first exposure part
222: second exposure part
230: ball insertion grove
240: second side wall insertion part
250: leg line mounting part
251: first electric wire mounting part
252: second electric wire mounting part
300: upper casing member
300*a*: upper side wall
300*b*: first side wall insertion part
310: wire-connecting press part
311: bracket insertion part
311*a*: first bracket insertion part
311*b*: second bracket insertion part
311*c*: first leading line pressing groove
311*d*: second leading line pressing groove
320: first upper passing hole
321: first leading line partitioning part
330: second upper passing hole
331: second leading line partitioning part
340: electric wire pressing part
341: first electric wire pressing part
342: second electric wire pressing part
343: third electric wire pressing part

400: casing connection hinge part
410: casing connection member
420: casing support member
430: casing opening guide member
431: first opening guide surface
440: rotation guide member
441: second opening guide surface
500: casing locking part
510: locking member
511: elastic support part
512: first locking part
513: push part
520: locking coupling part
521: second locking part
600: connection insertion part

BEST MODE

Hereinafter, the present disclosure will be described in more detail.

Exemplary embodiments of the present disclosure will be described in detail with reference to the accompanying drawings as follows. Prior to the detailed description of the present disclosure, all terms or words used in the description and claims should not be interpreted as being limited merely to common and dictionary meanings. Meanwhile, the embodiments described in the specification and the configurations illustrated in the drawings are merely examples and do not exhaustively present the technical spirit of the present disclosure. Accordingly, it should be appreciated that there may be various equivalents and modifications that can replace the embodiments and the configurations at the time at which the present application is filed.

Figure 2A:
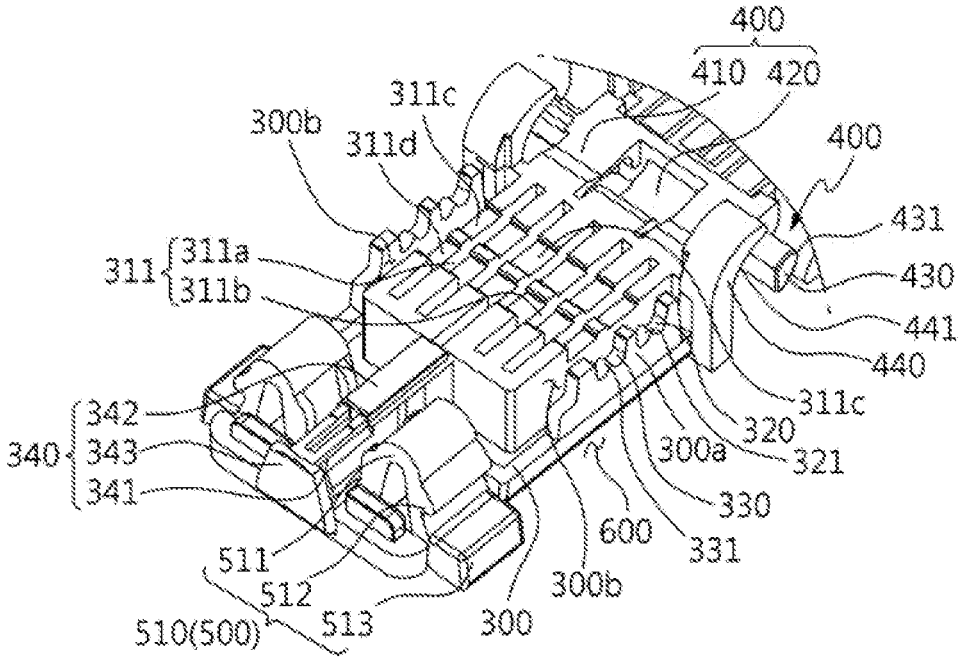
FIGS. 2A and 2B are enlarged-perspective views showing an upper casing member and a lower casing member of the detonation connector having a tagging exposure part according to the embodiment of the present disclosure.
Figure 2B:
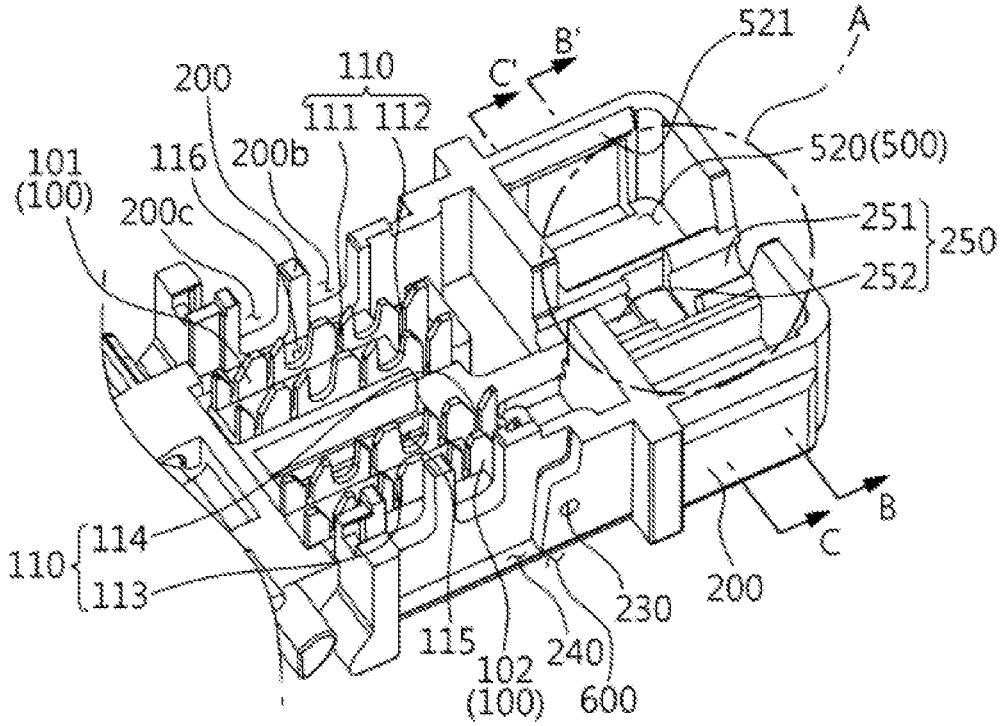
Figure 3:
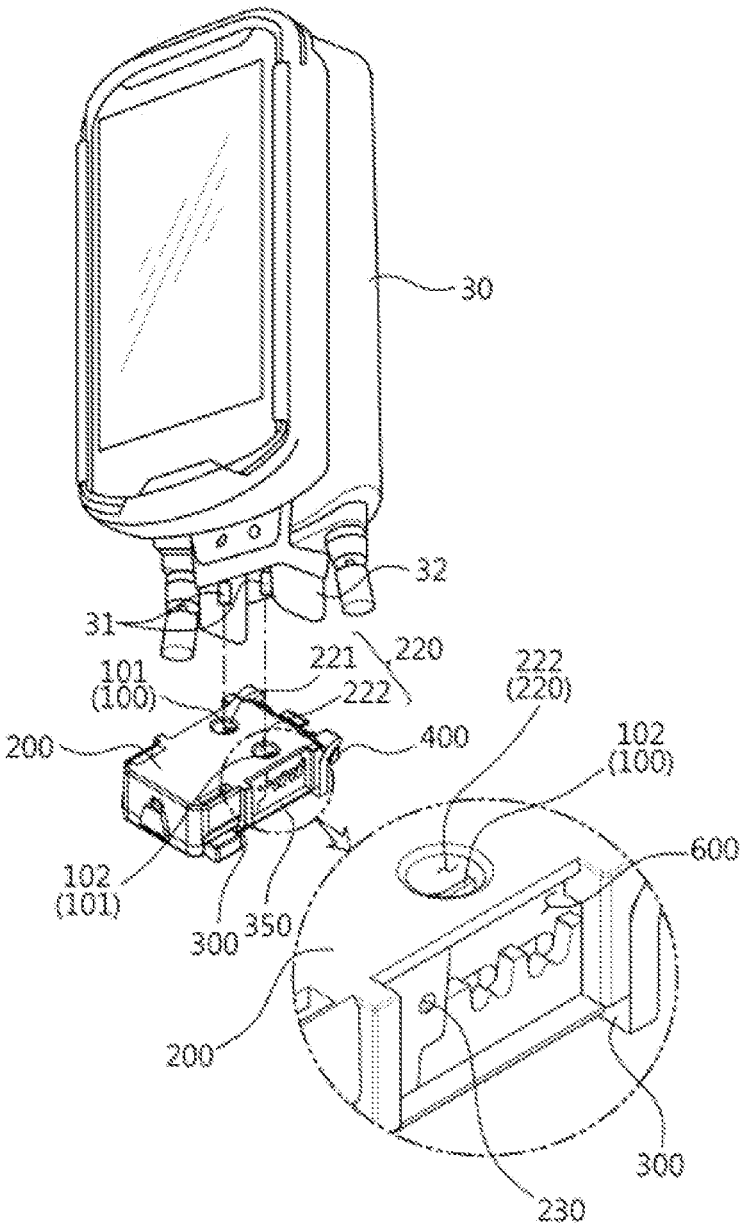
FIG. 3 is a bottom-perspective view showing the detonation connector having a tagging exposure part according to the embodiment of the present disclosure.

FIG. 1 is an exploded-perspective view showing a detonation connector having a tagging exposure part 220 according to an embodiment of the present disclosure; FIGS. 2A and 2B are enlarged-perspective views showing a lower casing member 200 and an upper casing member 300 of the detonation connector having the tagging exposure part 220 according to the embodiment of the present disclosure; and FIG. 3 is a bottom-perspective view showing the detonation connector having the tagging exposure part 220 according to the embodiment of the present disclosure.

FIG. 1 is the exploded-perspective view showing a state where the upper casing member 300 is opened and then a wire-connecting bracket member 100 is separated from the detonation connector. FIG. 2A is an enlarged-perspective view of the upper casing member 300 and FIG. 2B is an enlarged-perspective view of the lower casing member 200. FIG. 3 is the bottom-perspective view showing a lower surface of the lower casing member 200 when the upper casing member 300 is closed.

Figure 4:
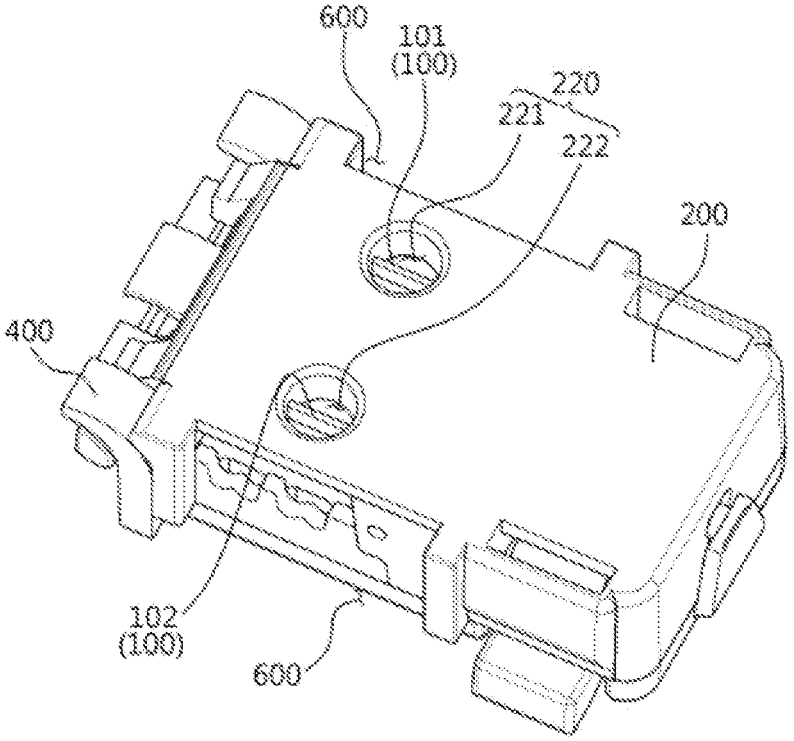
FIG. 4 is a bottom view showing the detonation connector having a tagging exposure part according to the embodiment of the present disclosure.
Figure 5:
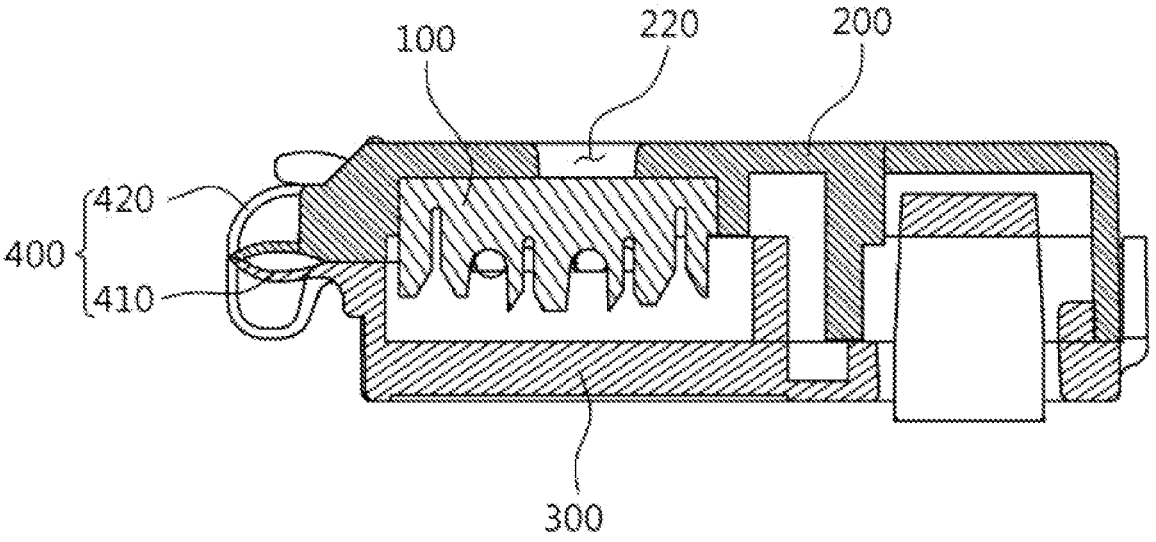
FIG. 5 is a sectional view showing the detonation connector having a tagging exposure part according to the embodiment of the present disclosure.

FIG. 4 is a bottom view showing the detonation connector having the tagging exposure part 220 according to the embodiment of the present disclosure, FIG. 4 shows the lower surface of the lower casing member 200 when the upper casing member 300 is closed; and FIG. 5 is a sectional view showing the detonation connector having the tagging exposure part 220 according to the embodiment of the present disclosure.

Figure 6:
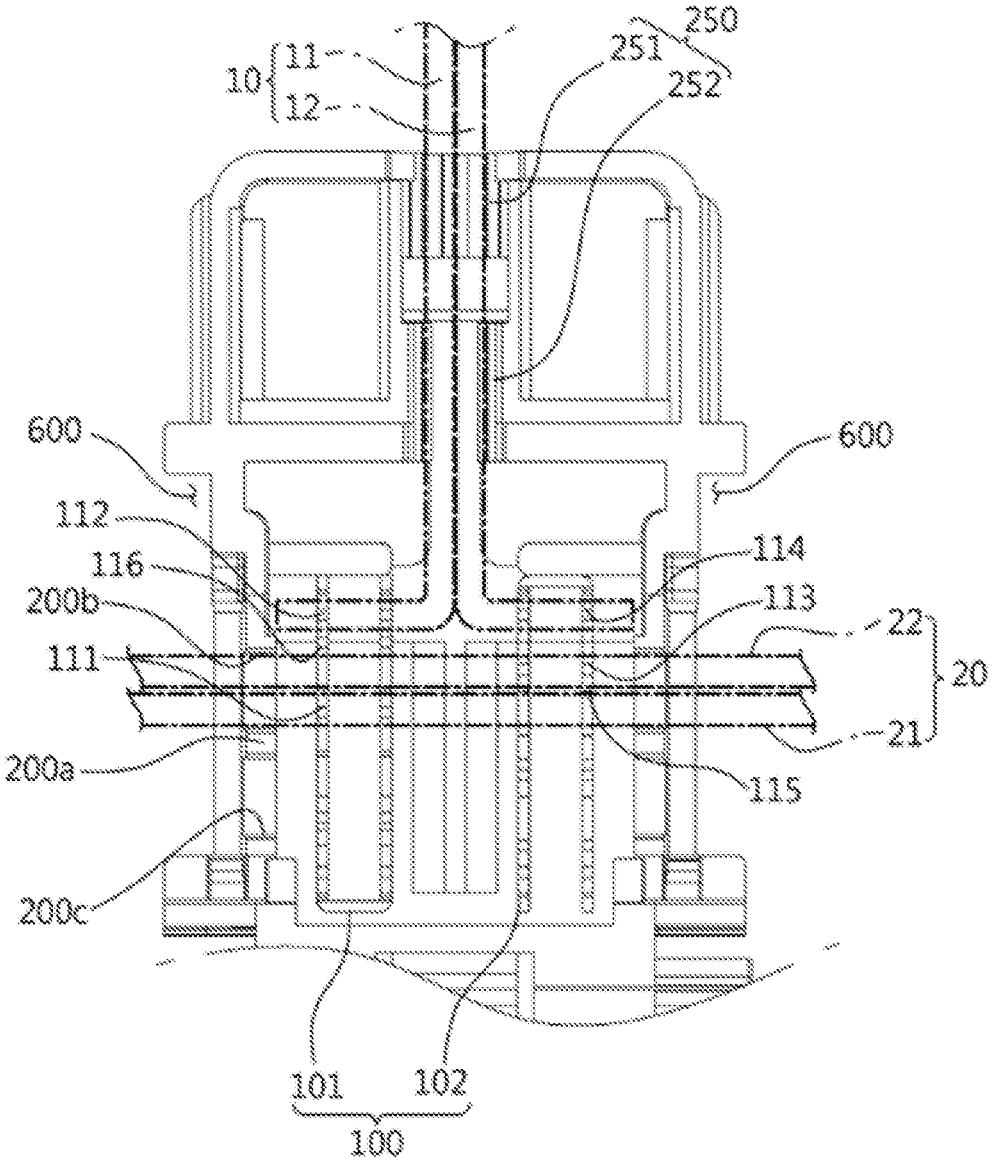
FIG. 6 is a plan view showing the lower casing of the detonation connector having a tagging exposure part according to the embodiment of the present disclosure.

FIG. 6 is a plan view showing the lower casing of the detonation connector having the tagging exposure part 220 according to the embodiment of the present disclosure, and FIG. 6 shows a wiring example of a leg line 10 and a leading line 20 inside the lower casing member 200.

Hereinafter, the detonation connector having the tagging exposure part 220 according to the embodiment of the present disclosure will be described in detail with reference to FIGS. 1 to 6.

The detonation connector having the tagging exposure part 220 according to the embodiment of the present disclosure may include the wire-connecting bracket member 100 having a plurality of electric wire mounting grooves 110 to which a leg line 10 or a leading line 20 of a detonator is mounted.

Each of the electric wire mounting grooves 110 has a 'V'-shaped guide part at an opening thereof to guide an electric wire to be mounted into the electric wire mounting groove 110. Thus, when the upper casing member 300 is closed, the leading line 20 is pressed to be easily mounted into the electric wire mounting groove 110.

The wire-connecting bracket member 100 is made of an electrically conductive material, so that the leg line 10 of the detonator or the leading line 20 and a blasting device, which are mounted to the electric wire mounting grooves 110, are electrically connected to each other.

The wire-connecting bracket member 100 is made of a material such as copper or aluminum having excellent conductivity, and may be made of any known materials that can electrically connect the leg line 10 with the leading line 20.

The wire-connecting bracket member 100 is configured such that the leg line 10 is mounted to a groove on a first side of the electric wire mounting grooves 110, and the leading line 20 is mounted to a groove on a second side of the electric wire mounting grooves 110, thereby wire-connecting the leg line 10 with the leading line 20.

The leg line 10 or the leading line 20 may be embedded in various modifications using a known wire formed by coating a wire with a sheath, so a detailed description thereof will be omitted.

The leg line 10 is connected to the wire-connecting bracket member 100 by passing through the groove on the first side of the electric wire mounting grooves 110, and the leading line 20 is connected to the wire-connecting bracket member 100 by passing through the groove on the second side of the electric wire mounting grooves 110.

As the leg line 10 and the leading line 20 mounted to the different electric wire mounting grooves 110 are electrically connected to a connecting bracket, the leg line 10 and the leading line 20 are wire-connected to each other.

The leg line 10 and the leading line 20 are configured such that sheaths thereof are peeled off in a portion thereof mounted to the electric wire mounting grooves 110 to expose inner wires. Then, as the exposed inner wires of the leg line 10 and the leading line 20 are connected to the connecting bracket, the leg line 10 and the leading line 20 are wire-connected to each other through the wire-connecting bracket made of a conductive material.

The wire-connecting bracket member 100 is positioned on an upper surface of the lower casing member 200. Further, a bracket mounting part 210 is positioned on the upper surface of the lower casing member 200 for mounting and fixing of the wire-connecting bracket member 100.

The wire-connecting bracket member 100 is formed in a 'U'-shape, so that the leg line 10 and the leading line 20 are connected to the wire-connecting bracket member by double contacts, respectively.

As an example, the wire-connecting bracket member 100 has the 'U'-shape, which is formed such that a pair of brackets each having the electric wire mounting grooves 110 to which the leg line 10 or the leading line 20 is mounted are connected to each other by a connection bracket.

The leg line 10 or the leading line 20 is brought into an electrically connected state by being mounted to the electric wire mounting grooves 110 of the pair of brackets. Accordingly, the leg line 10 or the leading line 20 has the double contact structure to maintain a stable wire-connection state.

The wire-connecting bracket member 100 includes a first wire-connecting bracket part 101 and a second wire-connecting bracket part 102. The first wire-connecting bracket part 101 includes: a first leading line mounting groove 111 to which a first leading line 21 is mounted; a second leading line passing hole 116 through which a second leading line 22 passes; and a first leg line mounting groove 112 to which a leg line 11 electrically connected to the first leading line 21 is mounted. The second wire-connecting bracket part 102 includes: a first leading line passing hole 115 through which the first leading line 21 passes; a second leading line mounting groove 113 to which the second leading line 22 is mounted; and a second leg line mounting groove 114 to which a second leg line 12 is mounted.

Further, the first wire-connecting bracket part 101 includes a pair of first bracket part and a first connection bracket connecting the pair of first bracket part together, thereby forming the 'U'-shape, the pair of first bracket part each having the first leading line mounting groove 111 to which the first leading line 21, the second leading line passing hole 116 through which the second leading line 22, and the first leg line mounting groove 112 to which the first leg line 11 electrically connected to the first leading line 21 is mounted. Accordingly, as the first leading line 21 is mounted to two first leading line mounting grooves 111, and the first leg line 11 is mounted two first leg line mounting grooves 112, the first leading line 21 and the first leg line 11 have the double contact structures.

The second wire-connecting bracket part 102 includes a pair of second bracket part and a second connection bracket connecting the pair of second bracket parts together, thereby forming the 'U'-shape, the pair of second bracket part each having the first leading line passing hole 115 through which the first leading line 21 passes, the second leading line mounting groove 113 to which the second leading line 22 is mounted, and the second leg line mounting groove 114 to which the second leg line 12 is mounted. Accordingly, as the second leading line 22 is mounted to two second leading line mounting grooves 113, and the second leg line 12 is mounted two second leg line mounting grooves 114, the second leading line 22 and the second leg line 12 have the double contact structures.

The leading line 20 includes the first leading line 21 for (+) and the second leading line 22 for (−). The leg line 10 includes the first leg line 11 for (+) that is electrically connected to the first leading line 21 for (+), that is, wire-connected thereto, through the first wire-connecting bracket part 101, and the leg line 10 including the second leg line 12 for (−) that is electrically connected to the second leading line 22 for (−), that is, wire-connected thereto, through the second wire-connecting bracket part 102.

The first wire-connecting bracket part 101 and the second wire-connecting bracket part 102 are positioned parallel to each other on the upper surface of the lower casing member. The first leading line mounting groove 111 and the first leading line passing hole 115 are positioned in a straight line, and the second leading line mounting groove 113 and the second leading line passing hole 116 are positioned in a straight line.

The first leading line 21 is mounted to the first leading line mounting groove 111 and connected to the first wire-connecting bracket part 101, and then passes through the first leading line passing hole 115. Thus, the first leading line passes from a first side of the lower casing member 200 to a second side thereof in a state of being disconnected to the second wire-connecting bracket part 102 without being connected thereto.

The second leading line 22 is mounted to the second leading line mounting groove 113 to be connected to the second wire-connecting bracket part 102, and then passes through the second leading line passing hole 116. Thus, the second leading line 22 passes from the first side of the lower casing member 200 to the second side thereof in a state of being disconnected to the first wire-connecting bracket part 101 without being connected.

The lower casing member 200 is provided with lower side walls **200*a* protruding upwards from opposite side surfaces thereof. Each of the opposite lower side walls 200*a* has a first lower passing hole 200*b* and a second lower passing hole 200*c* through which the first leading line 21 and the second leading line 22** pass, respectively.

The lower casing member 200 has an opening at a front surface thereof so that the leg line 10 may be inserted into the lower casing member 200. The lower casing member 200 has a leg line mounting part 250 therein, the leg line mounting part 250 is connected with the opening of the lower casing member 200 and is provided to fix the inserted leg line in a mounted state.

The leg line mounting part 250 is positioned in a straight line at the center of the lower casing member 200 in a longitudinal direction thereof, so that the leg line 10 may be positioned in the straight line between the first wire-connecting bracket part 101 and the second wire-connecting bracket part 102.

The leg line mounting part 250 is a passage open toward the front of the lower casing member 200. When the leg line 10 is inserted into the lower casing member 200, and then is mounted to the leg line mounting grooves 112 and 114 of the wire-connecting bracket member 100, the leg line 10 is wire-connected with the leading line 20 through the wire-connecting bracket member 100.

In detail, the first leg line 11 is mounted to the first leg line mounting groove 112 of the first wire-connecting bracket part 101 by passing through the leg line mounting part 250, so that the first leg line 11 is wire-connected with the first leading line 21. The second leg line 12 is mounted to the second leg line mounting groove 114 of the second wire-connecting bracket part 102, so that the second leg line 12 is wire-connected with the second leading line 22.

The first lower passing hole **200*b* and the second lower passing hole 200*c* are positioned perpendicular to the leg line mounting part 250**.

The first lower passing hole **200*b* and the second lower passing hole 200*c* have open upper portions to allow the first leading line 21 and the second leading line 22 to be inserted into the lower casing member through the open upper portions thereof. Accordingly, the first leading line 21 and the second leading line 22 are pressed by the upper casing member 300 so that the first wire-connecting bracket part 101 is coupled to the first leading line 21 and the second leading line 22 and the second wire-connecting bracket part 102 is coupled to the first leading line 21 and the second leading line 22**.

The bracket mounting part 210 includes a first bracket mounting part 211 and a second bracket mounting part 212. The first bracket mounting put 211 is provided to be coupled to the first wire-connecting bracket part 101 and second bracket mounting part 212 is coupled to the second wire-connecting bracket part 102.

As an example, the first bracket mounting part 211 and the second bracket mounting part 212 have 'U'-shapes corresponding to the shapes of the fast wire-connecting bracket part 101 and the second wire-connecting bracket part 102.

The first wire-connecting bracket part 101 and the second wire-connecting bracket part 102 are coupled to the first bracket mounting part 211 and the second bracket mounting part 212 respectively in a mounted state, and are positioned in a state of protruding on the upper surface of the lower casing member 200.

As an example, the lower side walls 200*a* of the lower casing member 200 protrude on the upper surface of the lower casing member 200 with having heights equal to or higher than heights of the first wire-connecting bracket part 101 and the second wire-connecting bracket part 102.

The first wire-connecting bracket part 101 and the second wire-connecting bracket part 102 are positioned between the lower side walls 200*a* of the lower casing member 200, the lower side walls 200*a* protruding upwards from the upper surface of the lower casing member 200. The first leading line mounting groove 111, the first leading line passing hole 115, and the first lower passing hole 200*b* of the lower side walls 200*a* are positioned in a straight line. The second leading line mounting groove 113, the second leading line passing hole 116, and the second lower passing hole 200*c* of the lower side walls 200*a* are positioned in a straight line.

The first leading line 21 is wired by passing through the first leading line mounting groove 111, the first leading line passing hole 115, and the first lower passing hole 200*b* of the lower side walls 200*a* that are positioned in the straight line. The second leading line 22 is wired by passing through the second leading line mounting groove 113, the second leading line passing hole 116, and the second lower passing hole 200*c* of the lower side walls 200*a*.

The first leg line 11 is wired by being inserted into the lower casing member 200 through the leg line mounting part 250 and then being bent to be mounted to the first leg line mounting groove 112 of the first wire-connecting bracket member 101. The second leg line 12 is wired by being inserted into the lower casing member 200 through the leg line mounting part 250 and then being bent in an opposite direction to the first leg line 11 to be mounted to the second leg line mounting groove 114 of the second wire-connecting bracket member 102.

The inside of the lower casing member 200 is opened and closed by the upper casing member 300. The upper casing member 300 covers an open upper portion of the lower casing member 200 to protect the leading line 20 and the leg line 10 that are internally wire-connected to each other from the outside environment.

The upper casing member 300 is connected to a rear surface of the lower casing member 200, and is rotated around a connected portion so as to open and close the inside of the lower casing member 200.

A casing connection hinge part 400 is provided at the rear surface of the lower casing member 200 and a rear surface of the upper casing member 300 to connect the lower casing member 200 with the upper casing member 300 in a state where the upper casing member 300 is rotatable.

Further, a casing locking part 500 is provided at a front surface of the lower casing member 200 and a front surface of the upper casing member 300 to fix a position of the closed upper casing member 300. The casing locking part 500 is configured to lock the position of the upper casing member 300 that is seated on the upper portion of the lower casing member 200 and covers the upper portion of the lower casing member 200, and to release the locking state thereof to allow the lower casing member 200 to be opened.

By the casing locking part 500, the upper casing member 300 is maintained in a state of covering the upper portion of the lower casing member 200. When the locking state of the casing locking part 500 is released, the upper casing member 300 is lifted while being rotated around the casing connection hinge part 400, and opens the inside of the lower casing member 200.

The casing locking part 500 includes a locking member 510 and a locking coupling part 520. The locking member 510 is positioned at any one side of the upper casing member 300 and the lower casing member 200, and the locking coupling part 520 is positioned at another side of the upper casing member 300 and the lower casing member 200 and is removably coupled to the locking member 510.

The locking member 510 consists of an elastic support part 511, a first locking part 512, and a push part 513, and is provided at each of opposite sides of the upper casing member 300. The elastic support part 511 has a curved form with elasticity, the first locking part 512 protrudes from an outer side surface of the elastic support part 511, and the push part 513 is positioned at an end of the elastic support part 511 and protrudes toward an upper side wall 300*a* of the upper casing member 300.

The locking coupling part 520 is formed for the elastic support part 511 to be inserted therein, and has a second locking part 521 protruding from an inner side surface of the locking coupling part 520, so that the first locking part 512 is elastically locked by the second locking part 521.

The locking member 510 is provided as a pair of locking members 510 at opposite sides of a front portion of the upper casing member 300. The locking coupling part 520 is provided as a pair of locking coupled parts 520 in correspondence to the locking members 510 at opposite sides of a front portion of the inside of the lower casing member 200.

When the upper casing member 300 is closed, the elastic support part 511 is inserted into the locking coupling part 520, and the first locking part 512 is positioned in a state of being locked by the second locking part 521, so that the upper casing member 300 is maintained in the closed state.

When a pair of push parts 513 protruding toward upper side walls 300*a* of the upper casing member 300 are pressed, the first locking part 512 is released from a state of being locked by the second locking part 521. Then, the upper casing member 300 is rotated around the casing connection hinge part 400, so that the lower casing member 200 may be opened.

Meanwhile, the upper casing member 300 is provided with a wire-connecting press part 310 at a lower surface thereof. The wire-connecting press part 310 presses the leg line 10 or the leading line 20 to insert the leg line 10 or the leading line 20 into the electric wire mounting grooves 110, so that the leg line 10 or the leading line 20 is wire-connected to the wire-connecting bracket member 100.

The wire-connecting press part 310 presses the leg line 10 or the leading line 20 to allow the leg line 10 or the leading line 20 to be mounted to the electric wire mounting grooves 110. Thus, as a sheath of the leg line 10 or the leading line 20 is peeled off inside the electric wire mounting grooves 110 the leg line 10 or the leading line 20 may be electrically connected, that is, wire-connected, to the wire-connecting bracket member 100.

The electric wire mounting grooves 110 is formed with a width equal to or less than a diameter of a wire in a form of peeling a sheath from the leg line 10 or the leading line 20. When the leg line 10 or the leading line 20 is mounted to the electric wire mounting grooves 110, the leg line 10 or the leading line 20 may be mounted to the electric wire mounting grooves 110 while a sheath thereof is removed.

The leg line 10 or the leading line 20 is pressed by the wire-connecting press part 310 from a state of placed on openings of the electric wire mounting grooves 110, that is, the 'V'-shaped guide part thereof, and then is mounted to the electric wire mounting grooves 110. At this time, a sheath of the leg line 10 or the leading line 20 is peeled off only at a portion mounted to the electric wire mounting grooves 110, so that the leg line 10 or the leading line 20 is electrically connected to the wire-connecting bracket member 100, that is, wire-connected thereto.

The wire-connecting press part 310 has a bracket insertion part 311, so that the wire-connecting bracket member 100 protrudes from the upper surface of the lower casing member 200 is partially inserted into the wire-connecting press part 310 when the upper casing member 300 is closed.

When the upper casing member 300 is closed, as the wire-connecting bracket member 100 is inserted into the bracket insertion part 311, the wire-connecting press part 310 presses the leg line 10 or the leading line 20 placed on the 'V'-shaped guide part of the electric wire mounting grooves 110. Thus, the leg line 10 or the leading line 20 may be mounted to the electric wire mounting grooves 110.

When the upper casing member 300 is closed, the wing press part 310 presses the leg line 10 or the leading line 20 inside the lower casing member 200. Thus, a position of the leg line 10 or the leading line 20 may be firmly fixed.

The wire-connecting press part 310 may have a first leading line pressing groove 311*c* and a second leading line pressing groove 311*d* at an upper portion thereof. The first leading line pressing groove 311*c* is positioned in a straight line with the first leading line mounting groove 111, the first leading line passing hole 115, and the first lower passing hole 200*b* of lower side walls 200*a*. The second leading line pressing groove 311*d* is positioned in a straight line with the second leading line mounting groove 113, the second leading line passing hole 116, and the second lower passing ole 200*c* of the lower side walls 200*a*.

The bracket insertion part 311 has a pair of first bracket insertion parts 311*a* in which the pair of first brackets of the first wire-connecting bracket part 101 is inserted, and a pair of second bracket insertion parts 311*b* in which the pair of second brackets of the second wire-connecting bracket part 102 is inserted.

As an example, the first leading line pressing groove 311*c* and the second leading line pressing groove 311*d* are positioned in a straight line on a lower surface of the wire-connecting press part 310, the lower surface excluding the first bracket insertion parts 311*a* and the second bracket insertion parts 311*b*.

The upper casing member 300 is provided with the upper side walls 300*a* protruding from opposite sides thereof the upper side walls 300*a* partially overlapping the lower side walls.

The upper side walls 300*a* are positioned to partially overlap the lower side walls 200*a* in contact with outer side surfaces of the lower side walls 200*a*, when the upper casing member 300 is closed. At this time, the wire-connecting bracket member 100 is precisely inserted into the bracket insertion part 311, so that the leg line 10 or the leading line 20 is pressed by the wire-connecting press part 310 so as to be wire-connected to the wire-connecting bracket member.

A first side wall insertion part 300*b* is positioned between the wire-connecting press part 310 and the upper side wall 300*a*, so that an upper portion of each of the lower side walls 200*a* is partially inserted into the first side wall insertion part 300*b*. A second side wall insertion part 240 is positioned at the outside of the lower side wall 200*a*, so that the upper side wall 300*a* is inserted into the second side wall insertion part 240.

The second side wall insertion part 240 positioned at the outer side surface of the lower side wall 200*a* has a form of being engaged with the upper side wall 300*a*. The upper side wall 300*a* is coupled to the second side wall insertion part 240 by being supported at a front end and a rear end thereof by the second side wall insertion part 240.

The upper side walls 300*a* have a first upper passing hole 320 and a second upper passing hole 330. The first upper passing hole 320 is open at a lower portion thereof to be connected to the first lower passing hole 200*b*, and the second upper passing hole 330 is open at a lower portion thereof to be connected to the second lower passing hole 200*c*.

A first leading line partitioning part 321 is provided at the center of the first upper passing hole 320 to partition a space through which the first leading line 21 passes, and a second leading line partitioning part 331 is provided at the center of the second upper passing hole 330 to partition a space through which the second leading line 22 passes.

The first leading line partitioning part 321 divides the first upper passing hole 320 into two spaces through which the first leading line 21 and the second leading line 22 pass, respectively. The second leading line partitioning part 331 divides the second upper passing hole 330 into two spaces through which the first leading line 21 and the second leading line 22 pass, respectively.

That is, the first leading line 21 and the second leading line 22 may select any one of the first upper passing hole 320 and the second upper passing hole 330 to pass through the selected hole.

The first upper passing hole 320 is divided into the two spaces, so that the first leading line 21 and the second leading line 22 may respectively and separately pass through the two spaces. The second upper passing hole 330 is divided into the two spaces, so that the first leading line 21 and the second leading line 22 may respectively and separately pass through the two spaces.

When the upper casing member 300 is closed by being rotated around the casing connection hinge part 400, a part of the upper portion of the lower side walls 200*a* is inserted into the first side wall insertion part 300*b* and upper side walls 300*a* is engaged with the second side wall insertion part 240. Accordingly, the wire-connecting bracket member 100 may be precisely inserted into the bracket insertion part 311.

The first leading line 21 is fixed in a state of being pressed between the first lower passing hole 200*b* and the first upper passing hole 320, thereby minimizing damage thereof due to bending. The second leading line 22 is fixed in a state of being pressed between the second lower passing hole 200*c* and the second upper passing hole 330, thereby minimizing damage thereof due to bending.

The first leading line 21 and the second leading line 22 are fixed by being fitted between the upper side walls 300*a* and the lower side walls 200*a* at opposite sides of each of the upper casing member 300 and the lower casing member 200. Accordingly, positions of the first leading line 21 and the second leading line 22 may be stably fixed, and thus connection states between the first and second leading lines 21 and the wire-connecting bracket member 100 may be stably maintained.

The first wire-connecting bracket part 101 may be configured such that, the first leading line mounting groove 111 is positioned in correspondence to the first lower passing hole 200*b* and the first upper passing hole 320, and the second leading line passing hole 116 is positioned in correspondence to the second lower passing hole 200*c* and the second upper passing hole 330.

The second wire-connecting bracket part 102 may be configured such that, the first leading line passing hole 115 is positioned in correspondence to the first lower passing hole 200*b* and the first upper passing hole 320, and the second leading line mounting groove 113 is positioned in correspondence to the second lower passing hole 200*c* and the second upper passing hole 330.

Accordingly, the first leading line 21 and the second leading line 22 may be wired to pass through the first lower passing hole 200*b* and the first upper passing hole 320, or to pass through the second lower passing hole 200*c* and the second upper passing hole 330.

When the upper casing member 300 is closed, the wire-connecting bracket is precisely inserted into the bracket insertion part 311. Thus, the wire-connecting press part 310 presses the leg line 10 or the leading line 20 positioned at the openings of the electric wire mounting grooves 110 to couple the leg line 10 or the leading line 20 with the electric wire mounting grooves 110, thereby stably wire-connecting the leg line 10 and the leading line 20 to the wire-connecting bracket member 100.

Meanwhile, the casing connection hinge part 400 may be folded and unfolded multiple times. The casing connection hinge part 400 has a casing connection member 410 having opposite ends integrally connected to the rear surface of the lower casing member 200 and the rear surface of the upper casing member 300, respectively.

A folded portion of the casing connection member 410 serves as a rotation center of the upper casing member 300. The upper casing member 300 is rotated around the folded portion of the casing connection member 410 to open and close the upper portion of the lower casing member 200.

The casing connection member 410 is provided as a pair of casing connection members spaced apart from each other. Further, the casing connection hinge part 400 has a casing support member 420 between the spaced casing connection members 410, the casing support member 420 maintaining the upper casing member 300 inclined backwards in an inclined state.

The upper casing member 300, which is turned over, is supported in the inclined and lifted state while an upper surface of the upper casing member 300 is not parallel to the upper surface or the lower surface of the lower casing member 200.

Only when the turned-over upper casing member 300 is pushed by a force higher than a preset force, the casing support member 420 supports the upper casing member 300, so that the upper casing member 300 is rotated toward the lower casing member 200.

Opposite ends of the casing support member 420 are respectively and integrally connected to the rear surface of the lower casing member 200 and the rear surface of the upper casing member 300. When the upper casing member 300 is rotated, the casing support member 420 has a structure in which the upper casing member is folded inwards within a preset angle range and unfolded again when departing from the preset angle range.

The casing support member 420 is provided with a curved line part that is curved inwards from the center between the opposite sides of the casing support member 420. The curved line part has a structure in which the curved line part is curved inwards within a preset angle range of the upper casing member 300 when the upper casing member 300 is rotated, and the curved line part is unfolded again when the upper casing member 300 departs from the preset angle range.

The upper casing member 300 is rotated and turned over from a seated state on the upper portion of the lower casing member 200 after the locked state thereof is released. Then, the upper casing member 300 fully opens the lower casing member 200 to allow the leg line 10 and the leading line 20 to be positioned in the electric wire mounting grooves 110 of the wire-connecting bracket member 100.

The casing connection hinge part 400 includes: a casing opening guide member 430 that protrudes rearwards from the rear surface of the lower casing member 200 and having a first opening guide surface 431 of a curved surface at apart of an outside surface thereof; and a rotation guide member 440 that protrudes from the rear surface of the upper casing member 300 in a bent shape and having a second opening guide surface 441 of a curved surface at an outside surface thereof the second opening guide surface 441 being in contact with the first opening guide surface 431. Thus, the casing connection hinge part 400 lifts the upper casing member 300 so that an angle between the upper surface of the lower casing member 200 and the lower surface of the upper casing member 300 becomes equal to or higher than a preset angle.

An opening guide passage is formed at side surface of the lower casing member 200 to be spaced apart from the casing opening guide member 430, so that the rotation guide member 440 may pass through the passage. The rotation guide member 440 passes through the opening guide passage and then the second opening guide surface 441 is moved in contact with the first opening guide surface 431.

Curvatures of the first opening guide surface 431 and the second opening guide surface 441 are different from each other, so that one of the first opening guide surface 431 and the second opening guide surface 441 pushes the other to rotate the upper casing member 300.

That is, the casing opening guide member 430 and the rotation guide member 440 are in contact with each other by the first opening guide surface 431 and the second opening guide surface 441 that have elasticity to allow the upper casing member 300 to be automatically opened and closed again. When the upper casing member 300 is closed, a state where one of the first opening guide surface 431 and the second opening guide surface 441 presses the other one to be elastically supported is maintained. When the locking state of the casing locking part 500 is released, the elastically supported state between the casing opening guide member 430 and the rotation guide member 440 is released and the upper casing member 300 is lifted to the preset angle.

Meanwhile, the lower casing member 200 or the upper casing member 300 has a tagging exposure part 220 exposing a part of the wire-connecting bracket member 100.

The tagging exposure part 220 exposes a part of the wire-connecting bracket member 100 to allow the wire-connecting bracket member 100 wire-connecting the leg line 10 with the leading line 20 to be electrically connected with a tagging logger equipment 30 without opening the upper casing member 300.

The tagging exposure part 220 includes a first exposure part 221 and a second exposure part 222. The first exposure part 221 exposes the first wire-connecting bracket part 101 that binds the first leading line 21 and the first leg line 11, and the second exposure part 222 exposes the second wire-connecting bracket part 102 that binds the second leading line 22 and the second leg line 12.

As an example, the tagging exposure part 220 is positioned in a bottom surface of the lower casing member 200 and exposes a part of the wire-connecting bracket member 100.

When the tagging exposure part 220 is positioned in the upper surface of the upper casing member 300, the leading line 20 or the leg line 10 that are wire-connected by the wire-connecting bracket member 100 is exposed to the outside, thereby being damaged depending on the outside environment.

The tagging exposure part 220 is positioned in the lower casing member 200, so that the wire-connecting bracket member 100 is partially exposed and the leg line 10 or the leading line 20 is not exposed. Accordingly, the tagging exposure part 220 may have a structure of protecting the leg line 10 or the leading line 20 from the outside environment when the upper casing member 300 is closed.

In detail, the tagging exposure part 220 is formed in a groove-shaped space, which is connected to the bracket mounting part of the lower casing member 200 at the bottom surface of the lower casing member 200, in order to expose the wire-connecting bracket member 100 mounted to the bracket mounting part. The wire-connecting bracket member 100 is positioned to protrude from a void bottom of the tagging exposure part 220 that is formed in the groove-shaped space.

The first wire-connecting bracket part 101 and the second wire-connecting bracket part 102 exposed through the first exposure part 221 and the second exposure part 222 is positioned parallel to each other, and positioned to be stably connected to tagging terminals 31 of the tagging logger equipment 30, respectively.

The wire-connecting bracket member 100 protruding through the bottom of the tagging exposure part 220 is positioned lower than the bottom surface of the lower casing member 200.

That is, the height of the wire-connecting bracket member 100 protruding from the bottom of the tagging exposure part 220 is formed lower than the depth of the tagging exposure part 220 based on the bottom surface of the lower casing member 200.

The tagging logger equipment 30 is a known logger device, which is configured such that the tagging terminals 31 connected to the wire-connecting bracket member 100 protrude outwards on a front end of the logger device, charging initialization time to each detonator connected to each leg line 10 is performed in a state where the tagging terminal 31 is connected with the wire-connecting bracket member 100, the tagging work of checking for abnormalities in the connection of a detonator with the leg line 10 is performed, so a detailed description thereof will be omitted.

The tagging terminals 31 include a first tagging terminal electrically connected to the first wire-connecting bracket part 101, and a second tagging terminal electrically connected to the second wire-connecting bracket part 102.

Then, the tagging logger equipment 30 has a pair of tagging guide members 32. The tagging guide members 32 have protruding shapes, are positioned such that the tagging terminals 31 are positioned therebetween, and have inside surfaces that are supported by opposite side surfaces of the upper casing member 300 or the opposite side surfaces of the lower casing member 200.

The tagging guide members 32 have ball plungers 32*a* at the inside surfaces thereof. Ball insertion grooves 230 into which the ball plungers 32*a* are inserted are positioned in the side surfaces of the upper casing member 300 or the side surfaces of the lower casing member 200.

When the tagging guide members 32 are positioned at the opposite side surfaces of the upper casing member 300 or the opposite side surfaces of the lower casing member 200, and the ball plungers 32*a* are inserted into the ball insertion grooves 230, the tagging terminals 31 are inserted into the tagging exposure parts 220 and then are precisely connected with the wire-connecting bracket member 100.

As an example, are positioned at the opposite side surfaces of the lower casing member 200. As the ball plungers 32*a* of the tagging guide members 32 are inserted into the ball insertion grooves 230, the tagging terminals 31 for the tagging work are guided to be precisely connected to the wire-connecting bracket member 100.

According to the present disclosure, the detonation connector having the tagging exposure part 220 includes connection insertion parts 600 at opposite sides of the upper casing member 300 or opposite sides of the lower casing member 200, so that the tagging guide members 32 are inserted into the connection insertion parts 600 when the upper casing member 300 is closed.

The connection insertion parts 600 are formed in depressed shapes at the opposite side surfaces of the upper casing member 300 and the opposite side surfaces of the lower casing member 200, respectively. Accordingly, as the upper casing member 300 or the lower casing member 200 is positioned between the tagging guide members 32, the tagging terminals 31 are inserted into the tagging exposure parts 220 and may be stably connected to the wire-connecting bracket member 100 that is positioned inside the tagging exposure part 220.

Figure 7:
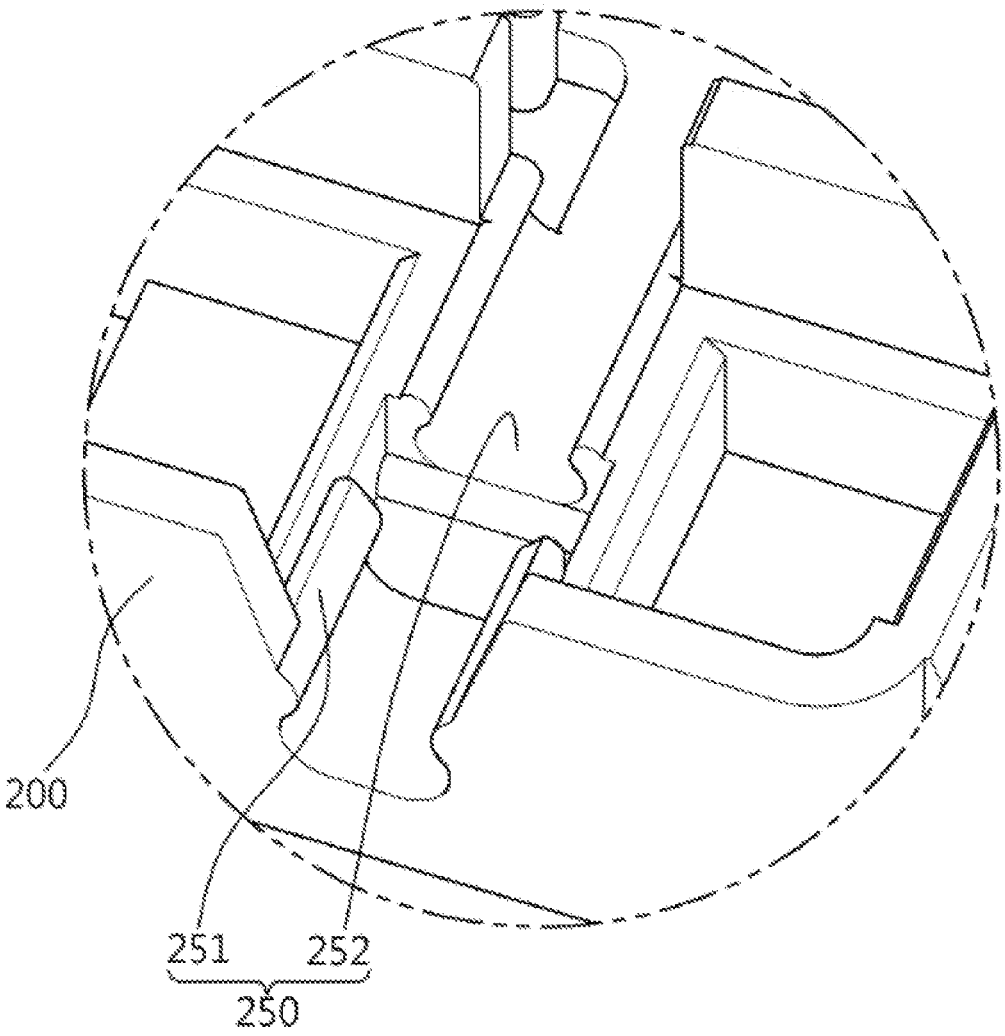
FIG. 7 is an enlarged view showing A part in FIG. 2B.
Figure 8:
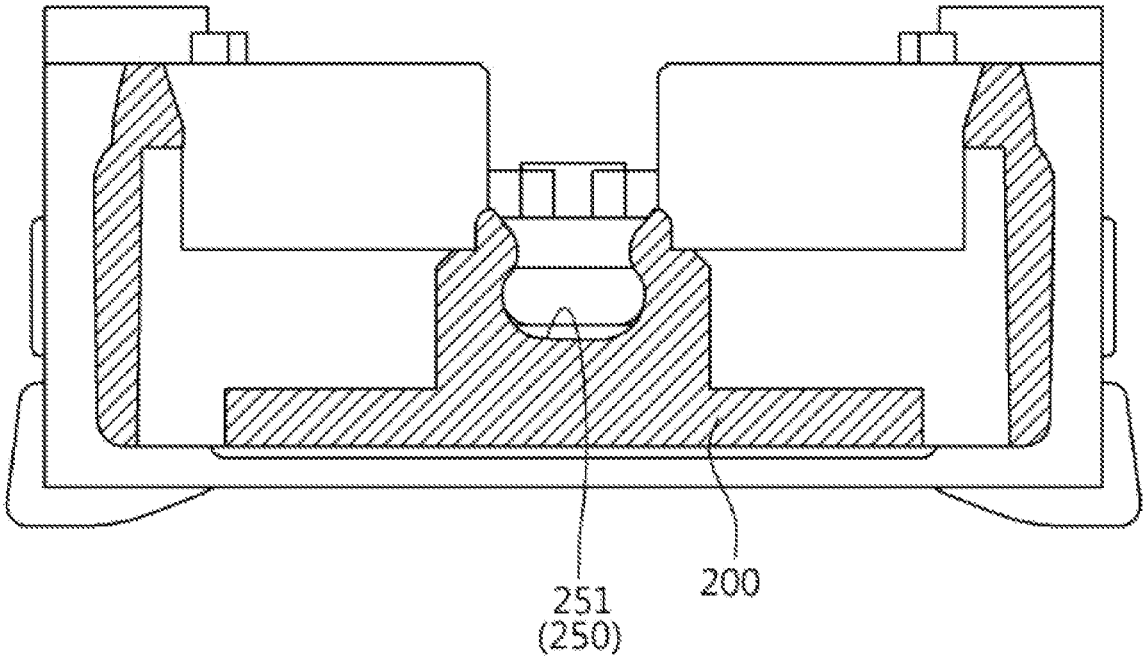
FIG. 8 is a sectional view taken along B-B' line in FIG. 2B.
Figure 9:
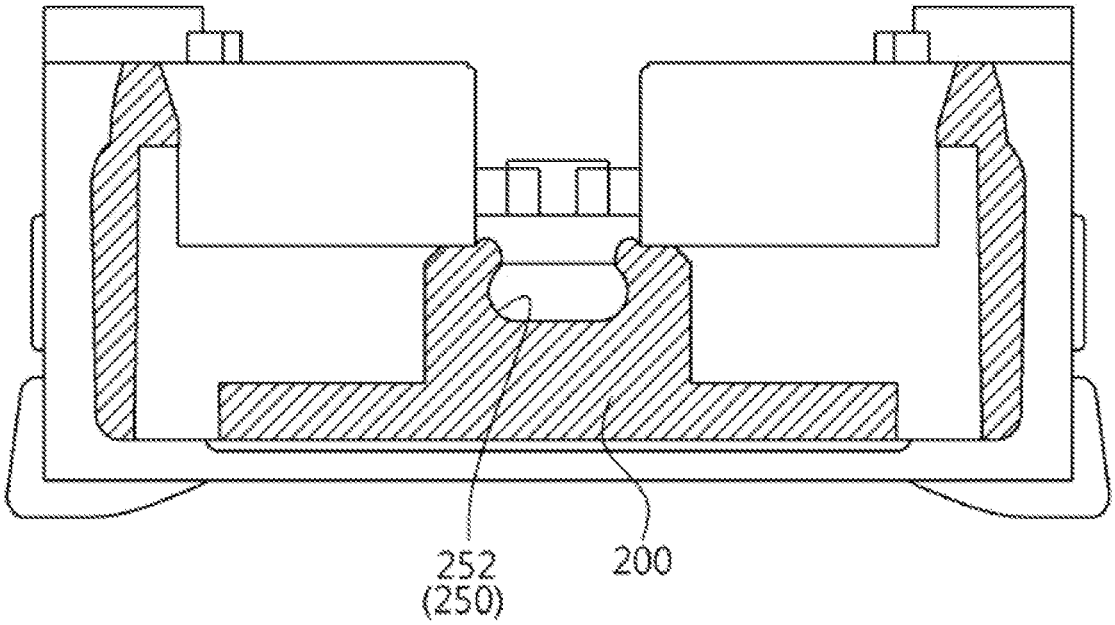
FIG. 9 is a sectional view taken along C-C' line in FIG. 2B.

Meanwhile, FIG. 7 is an enlarged view showing A part in FIG. 2B; FIG. 8 is a sectional view taken along B-B' line in FIG. 2B; and FIG. 9 is a sectional view taken along C-C' line in FIG. 2B.

Figure 10A:
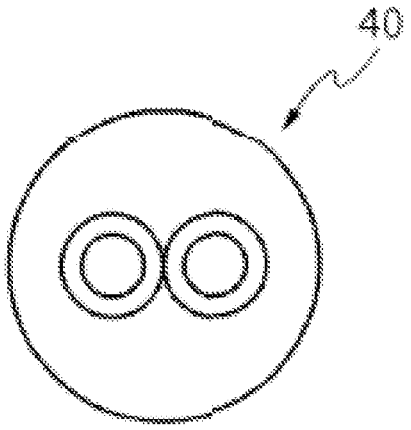
FIGS. 10A and 10B are a sectional view showing an embodiment of a leg line.
Figure 10B:
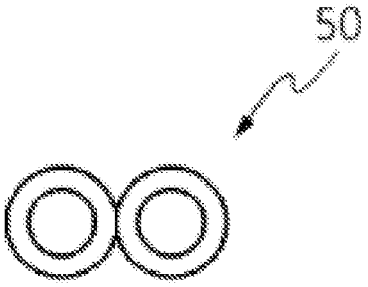

FIG. 10 is a sectional view showing an embodiment of a leg line. FIG. 10A is a view showing an example of a double coated electric wire 40, and FIG. 10B is a view showing an example of a single coated electric wire 50.

Referring to FIGS. 2, 7 to 9, and 10, the leg line mounting part 250 has a structure in which the double coated electric wire 40 or the single coated electric wire 50 is fixed in a state of mounted to the leg line mounting part 250.

In detail, the leg line mounting part 250 is positioned at the opening side of the lower casing member 200 and connected with the opening of the lower casing member 200. The leg line mounting part 250 includes a first electric wire mounting part 251 to which the double coated electric wire 40 is mounted, and a second electric wire mounting part 252 that is positioned in a straight line with the first electric wire mounting part 251 and fixing the single coated electric wire 50 in a state of being mounted thereto.

The leg line 10 may be the double coated electric wire 40, or may be the single coated electric wire 50.

As an example, the double coated electric wire 40 includes a first line including a first wire coated with a first sheath, a second line including a second wire coated with a second sheath, and an outer sheath coating the first and second lines.

As an example, the single coated electric wire 50 includes a first line including a first wire coated with a first sheath and a second line including a second wire coated with a second sheath.

The leg line mounting part 250 is positioned at the center of the lower casing member 200, and allows the first leg line 11 and the second leg line 12 to be stably wired by being bent toward the first wire-connecting bracket part 101 and the second wire-connecting bracket part 102 that are respectively positioned at the opposite sides of the lower casing member 200 on the basis of the center of the lower casing member 200.

The first electric wire mounting part 251 is formed to be partially open at an upper portion thereof in order to cover a part of the double coated electric wire 40, that is, to cover at least half of the double coated electric wire 40.

The first electric wire mounting part 251 has opposite ends with elasticity of the open upper portion thereof. Thus, the double coated electric wire 40 inserted in the first electric wire mounting part 251 is elastically pressed, so that a position of the double coated electric wire 40 is stably fixed.

The second electric wire mounting part 252 is formed to be partially open at an upper portion thereof in order to cover a part of the single coated electric wire 50, that is, to cover at least half of the single coated electric wire 50.

The second electric wire mounting part 252 has opposite ends with elasticity of the open upper portion thereof thus, the single coated electric wire 50 inserted in the second electric wire mounting part 252 is elastically pressed, so that a position of the single coated electric wire 50 is stably fixed.

According to the present disclosure, the detonation connector having the tagging exposure part 220 is provided with the first electric wire mounting part 251 in which the double coated electric wire 40 may be fixed and the second electric wire mounting part 252 in which the single coated electric wire 50 may be fixed. When the double coated electric wire 40 or the single coated electric wire 50 is used as the leg line 10, the double coated electric wire 40 or the single coated electric wire 50 is mounted to the opening side of the lower casing member 200, and a position of the double coated electric wire 40 or the single coated electric wire 50 is firmly fixed by the first electric wire mounting part 251 or the second electric wire mounting part 252. Accordingly, the leg line 10 may maintain the stable connection with the wire-connecting bracket in a state of being fixed inside the lower casing member 200.

That is, the leg line 10 using the double coated electric wire 40 or the single coated electric wire 50 is fixed by the first electric wire mounting part 251 or the second electric wire mounting part 252 at the opening side of the lower casing member 200. Therefore, the convenience of wiring operation, that is, the operation of wire-connecting an end of the leg line 10 to the electric wire mounting grooves 110 of the wire-connecting bracket, is improved, and the connection stability of the leg line 10 after wire-connection work is improved.

When the double coated electric wire 40 is used as the leg line 10, in order to connect the leg line 10 to the electric wire mounting grooves 110 of the wire-connecting bracket member 100 by pressure of the upper casing member 300, a part of the leg line 10 may be formed in a single coated electric wire by partially peeling off the outer sheath at an end of a inserted portion of the leg line 10 into the lower casing member 200.

That is, when the double coated electric wire 40 is used as the leg line 10, a portion of the leg line 10 where the outer sheath is not peeled off is fixed by the first electric wire mounting part 251 primarily. Secondarily, a portion of the leg line 10, which has a shape of the single coated electric wire 50 such that the outer sheath is peeled off like for connection to the wire-connecting bracket member 100, is fixed by the second electric wire mounting part 252. Accordingly, a position of the leg line 10 using the double coated electric wire 40 may be stably fixed inside the lower casing member 200.

Further, the upper casing member 300 is provided with an electric wire pressing part 340 at the lower surface thereof. The electric wire pressing part 340 presses an upper portion of the leg line 10 positioned in the leg line mounting part 250.

The electric wire pressing part 340 includes a first electric wire pressing part 341 and a second electric wire pressing put 342. The first electric wire pressing part 341 presses the double coated electric wire 40 positioned in the first electric wire mounting part 251, and the second electric wire pressing part 342 presses the single coated electric wire 50 positioned in the second electric wire mounting part 252.

The first electric wire pressing part 341 has a width that may pass through an upper open portion of the first electric wire mounting part 251. The first electric wire pressing part 341 presses the upper portion of the double coated electric wire 40 positioned in the first electric wire mounting part 251, so that a position of the double coated electric wire 40 may be stably and firmly fixed.

The second electric wire pressing part 342 has a width that may pass through an upper open portion of the second electric wire mounting part 252. The second electric wire pressing part 342 presses the upper portion of the double coated electric wire 40 positioned in the second electric wire mounting part 252, so that the position of the double coated electric wire 40 may be stably and firmly fixed.

At the front of the lower casing member 200, the opening of the lower casing member 200 is formed to be open upwards. The electric wire pressing part 340 may have a third electric wire pressing part 343, which is inserted into the lower casing member 200 and presses the upper portion of the leg line at the opening of the lower casing member 200.

The third electric wire pressing part 343 presses the leg line 10, that is, the double coated electric wire 40 or the single coated electric wire 50 at the opening of the lower casing member 200. Thus, a flow of an electric wire, that is, the leg line 10, is minimized at the opening of the lower casing member 200.

The present disclosure is configured such that the upper casing member 300 or the lower casing member 200 is provided with the tagging exposure part 220 that exposes a part of the wire-connecting bracket member 100 wire-connecting the leg line 10 and the leading line 20. Accordingly, the tagging work of charging initialization time to a detonator can be performed without opening the upper casing member 300, and the convenience and the efficiency of the tagging work can be improved.

The present disclosure is configured to have the double contact structure, thereby preforming the stable wire-connection of the leg line 10 and the leading line 20, so that the connection stability and the connection reliability of the leg line 10 and the leading line 20 can be secured. Further, it is possible to prevent the occurrence of large accidents due to malfunctions during wire-connection work, and to reduce the blasting delay time and the trouble shooting time that are critical issues caused by a connection problem.

The present disclosure is not limited to the above-described embodiments, and may be implemented as various modifications, additions and substitutions without departing from the scope and spirit of the present disclosure as disclosed in the accompanying claims, and the modifications and the like are included in the configuration of the present disclosure.

The invention claimed is:

1. A detonation connector having an exposure part for tagging, the detonation connector comprising:

a wire-connecting bracket member made of an electrically conductive material, and having a plurality of electric wire mounting grooves to which a leg line or a leading line of a detonator is mounted;

a lower casing member at which the wire-connecting bracket member is positioned; and an upper casing member covering an upper portion of the lower casing member, wherein the upper casing member or the lower casing member is provided with a tagging exposure part that exposes a part of the wire-connecting bracket member.

2. The detonation connector of claim 1, wherein a casing connection hinge part is provided at a rear surface of the lower casing member and a rear surface of the upper casing member to connect the lower casing member with the upper casing member in a state where the upper casing member is rotatable, and a casing locking part is provided at front surfaces of the lower casing member and the upper casing member to fix a position of the upper casing member in a closed state.

3. The detonation connector of claim 1, wherein the tagging exposure part comprises a first exposure part, which exposes a first wire-connecting bracket part that wire-connects a first leading line to a first leg line, and a second exposure part, which exposes a second wire-connecting bracket part that wire-connects a second leading line and a second leg line.

4. The detonation connector of claim 1, wherein the tagging exposure part is positioned in the lower casing member to expose apart of the wire-connecting bracket member.

5. The detonation connector of claim 1, wherein the tagging exposure part is formed in a groove-shaped void space at a bottom surface of the lower casing member, which is connected to a bracket mounting part, in order to expose the wire-connecting bracket member mounted to the bracket mounting part of the lower casing member, and the wire-connecting bracket member is positioned to protrude from a bottom of the tagging exposure part that is formed in the groove-shaped void space.

6. The detonation connector of claim 5, wherein a height of the wire-connecting bracket member is formed lower than a depth of the tagging exposure part based on the bottom surface of the lower casing member.

7. The detonation connector of claim 1, wherein, when tagging terminals of a tagging logger equipment are connected to the wire-connecting bracket member, opposite side surfaces of the upper casing member or opposite side surfaces of the lower casing member are supported between a pair of tagging guide members of the tagging logger equipment, and guide the wire-connecting bracket member to be connected to the tagging terminals.

8. The detonation connector of claim 7, wherein a side surface of the upper casing member or a side surface of the lower casing member is provided with a ball insertion groove in which a ball plunger that protrudes from an inside surface of each of the tagging guide members is inserted.

9. The detonation connector of claim 7, wherein connection insertion parts are positioned in opposite sides of the upper casing member or opposite sides of the lower casing member for insertion of the tagging guide members when the upper casing member is closed.

10. The detonation connector of claim 9, wherein the connection insertion parts are formed in a depressed shape at the opposite side surfaces of the upper casing member and the opposite side surfaces of the lower casing member, respectively, so that the upper casing member or the lower casing member is positioned between the tagging guide numbers, thus the opposite side surfaces of the upper casing member and the opposite side surfaces of the lower casing member are supported by being in contact with inside surfaces of the tagging guide members.

11. The detonation connector of claim 1, wherein, the lower casing member is provided with opposite lower side walls, the lower side walls protruding upwards, and each of the opposite lower side walls is provided with lower passing holes, the lower passing holes being open at upper portions thereof and passing the leading line, the upper casing member is provided with opposite upper side walls, the upper side walls protruding downwards and overlapping the lower side walls, each of the opposite upper side walls is provided with upper passing holes, the upper passing holes being open at lower portions thereof and passing the leading line, and the leading line is fixed in a state of being pressed between the lower passing holes and the upper passing holes.

12. The detonation connector of claim 11, wherein when the upper casing member is closed, the upper side walls are positioned to partially overlap the lower side walls in contact with outside surfaces of the lower side walls.

13. The detonation connector of claim 11, wherein each of the upper passing holes is provided with a leading line partitioning part at a center thereof, the leading line partitioning part protruding to partition a space through which the leading line passes.

14. The detonation connector of claim 1, wherein the lower casing member has an upper surface with a bracket mounting part to which the wire-connecting bracket member is coupled in a mounted state, the wire-connecting bracket member is mounted to the bracket mounting part to be positioned on the upper surface of the lower casing member in a state of protruding, the upper casing member has a lower surface with a wire-connecting press part that presses the leading line or the leg line to be inserted into the electric wire mounting grove so that the leg line or the leading line is wire-connected to the wire-connecting bracket member, the wire-connecting press part is provided with a bracket insertion part in which a part of the wire-connecting bracket member is inserted when the upper casing member is closed, and when the upper casing member is closed, the wire-connecting bracket member is inserted into the bracket insertion part, and then the wire-connecting press part presses the leg line or the leading line placed on an opening of the electric wire mounting groove in order to insert the leg line or the leading line into the electric wire mounting groove, so that a sheath of the leg line or the leading line is peeled off in the electric wire mounting groove and the leg line or the leading line is connected to the wire-connecting bracket member.

15. The detonation connector of claim 1, wherein the wire-connecting bracket member is formed in a 'U'-shape formed such that a pair of brackets each having a plurality of electric wire mounting grooves to which the leg line or the leading line is mounted are connected together by a connection bracket.

16. A detonation connector having an exposure part for tagging, the detonation connector comprising:

a wire-connecting bracket member made of electrically conductive material, and having a plurality of electric wire mounting grooves to which a leg line or a leading line of a detonator is mounted;

a lower casing member at which the wire-connecting bracket member is positioned; and an upper casing member covering an upper portion of the lower casing member, wherein a casing connection hinge part is provided at a rear surface of the lower casing member and a rear surface of the upper casing member to connect the lower casing member with the upper casing member in a state where the upper casing member is rotatable, a casing locking part is provided at front surfaces of the lower casing member and the upper casing member to fix a position of the upper casing member in a closed state, the lower casing member has an upper surface with a bracket mounting part to which the wire-connecting bracket member is coupled in a mounted state, the wire-connecting bracket member is mounted to the bracket mounting part to be positioned on the upper surface of the lower casing member in a state of protruding, the upper casing member has a lower surface with a wire-connecting press part that presses a leading line or a leg line to be inserted into the electric wire mounting groove so that the leg line or the leading line is wire-connected to the wire-connecting bracket member, the wire-connecting press part is provided with a bracket insertion part in which a part of the wire-connecting bracket member is inserted when the upper casing member is closed, when the upper casing member is closed, the wire-connecting bracket member is inserted into the bracket insertion part, and then the wire-connecting press part presses the leg line or the leading line placed on an opening of the electric wire mounting groove in order to insert the leg line or the leading line into the electric wire mounting groove, so that a sheath of the leg line or the leading line is peeled off in the electric wire mounting groove and the leg line or the leading line is connected to the wire-connecting bracket member, the upper casing member or the lower casing member is provided with a tagging exposure part that exposes a part of the wire-connecting bracket member, the tagging exposure part is formed in a groove-shaped void space at a bottom surface of the lower casing member, which is connected to a bracket mounting part, in order to expose the wire-connecting bracket member mounted to the bracket mounting part of the lower casing member, and the wire-connecting bracket member is positioned to protrude from a bottom of the tagging exposure part that is formed in the groove-shaped void space.

* * * * *